United States Patent [19]

Madray

[11] Patent Number: 4,551,957

[45] Date of Patent: Nov. 12, 1985

[54] BUILDING CONSTRUCTION

[76] Inventor: Herbert R. Madray, P.O. Box 712, Okeechobee, Fla. 33472

[21] Appl. No.: 496,960

[22] Filed: May 23, 1983

[51] Int. Cl.[4] ..... E04B 7/02

[52] U.S. Cl. ..... 52/90; 52/721; 403/170

[58] Field of Search ..... 52/90, 721, 91–94; 403/205, 403, 174, 178, 295, 170, 171; 446/476

[56] References Cited

U.S. PATENT DOCUMENTS

| | | | |
|---|---|---|---|
| 1,763,300 | 6/1930 | Gilbert | 446/476 |
| 2,082,138 | 6/1937 | Badel | 446/476 |
| 2,574,074 | 11/1951 | Vogel | 52/721 X |
| 3,304,683 | 2/1967 | Ferreira | 52/721 X |
| 3,471,981 | 10/1969 | Segil et al. | 52/220 |
| 3,653,172 | 4/1972 | Schwartz | 52/721 X |
| 3,787,130 | 1/1974 | Hemmings | 403/205 |
| 3,890,755 | 6/1975 | Specht | 52/721 X |
| 4,011,697 | 3/1977 | Fedolfi | 52/90 |
| 4,076,432 | 2/1978 | Glaser . | |
| 4,078,847 | 3/1978 | Presnick | 403/171 |
| 4,142,335 | 3/1979 | Andrade | 52/90 |
| 4,205,497 | 6/1980 | Schirm . | |
| 4,275,534 | 6/1981 | Porter . | |
| 4,305,677 | 12/1981 | Kowalski | 403/205 X |
| 4,347,015 | 8/1982 | Olashaw | 403/171 X |
| 4,350,318 | 9/1982 | Gallis | 52/721 X |
| 4,356,675 | 11/1982 | Reichèrts | 52/90 X |

FOREIGN PATENT DOCUMENTS

| | | | |
|---|---|---|---|
| 2430235 | 1/1975 | Fed. Rep. of Germany | 403/171 |
| 3033114 | 3/1982 | Fed. Rep. of Germany . | |
| 53974 | 8/1946 | France | 403/170 |
| 1229153 | 9/1960 | France . | |
| 783403 | 9/1957 | United Kingdom . | |
| 967965 | 8/1964 | United Kingdom | 403/171 |
| 1006324 | 9/1965 | United Kingdom | 52/93 |
| 1025751 | 4/1966 | United Kingdom | 52/93 |

*Primary Examiner*—J. Karl Bell

*Attorney, Agent, or Firm*—Steele, Gould & Fried

[57] ABSTRACT

A building structure having a plurality of substantially flat connector plate members, each having angularly related channel shaped receptacles to receive a plurality of load bearing girder, stud or rafter members. Each of the girder, stud or rafter members has a single channel shaped member for light constructions or a pair of oppositely directed channel shaped members having their webs secured together in back to back relation, and their flanges extending in opposite directions for use where heavy constructions or loads are involved. The girder, stud or rafter members are adapted to interfit with connector plate members in such a manner that the length of the girder, stud or rafter members can be extended in length by predetermined dimensional increments, such for example as at six inch spacings so as to readily permit the construction framework structures of any desired size. Any desired fasteners may be employed to secure the girder, stud or rafter members and the connector plate members together, such for example as oppositely directed screw threaded fasteners projecting through the connector plate and the girder stud or rafter members in alternately spaced opposite directions to insure a solid locking structure. The building structure is adapted to be mounted on a concrete foundation, wherein a channel shaped member supports the vertically extending load bearing stud members, and the stud members are anchored to the concrete foundation.

18 Claims, 21 Drawing Figures

Fig.-1
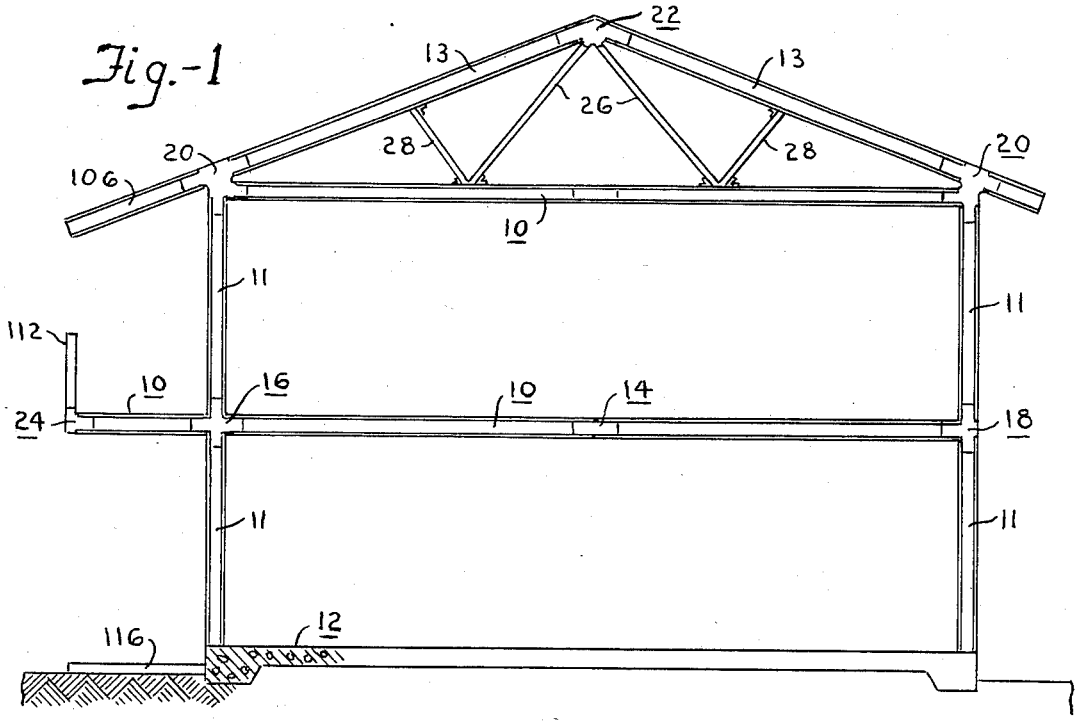
Fig.-2
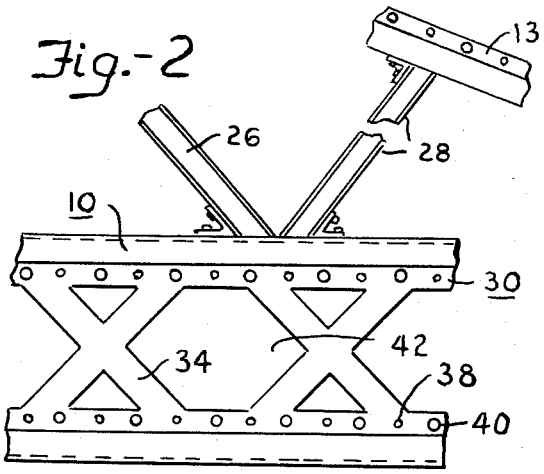
Fig.-3
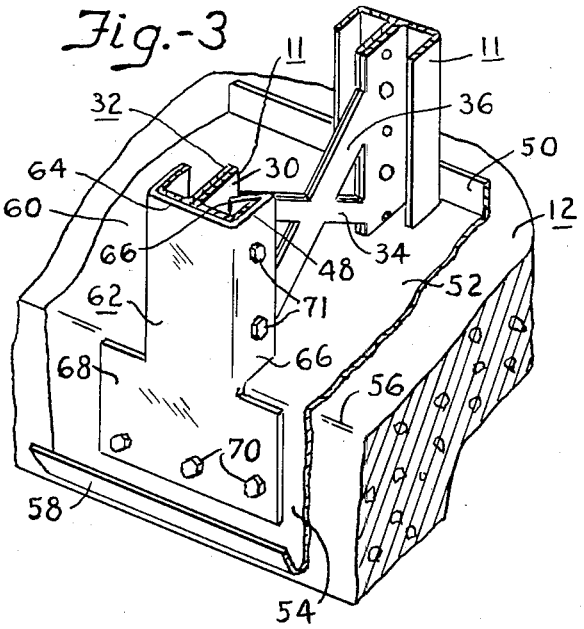
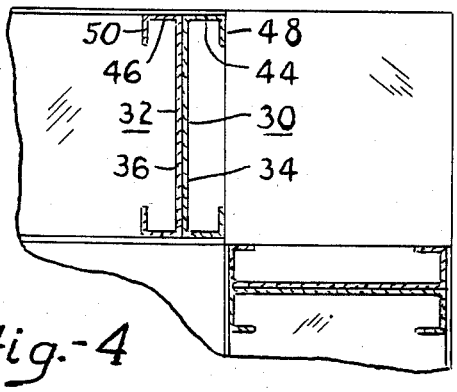
Fig.-4
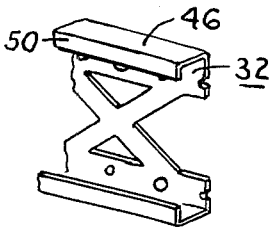
Fig.-5

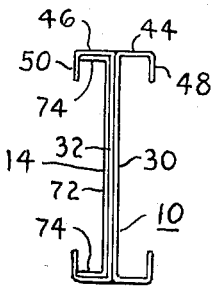
Fig.-7
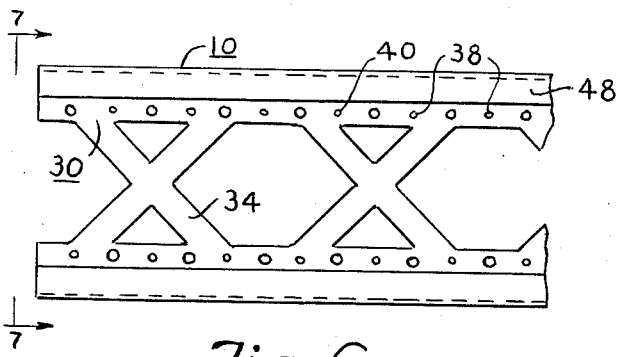
Fig.-6
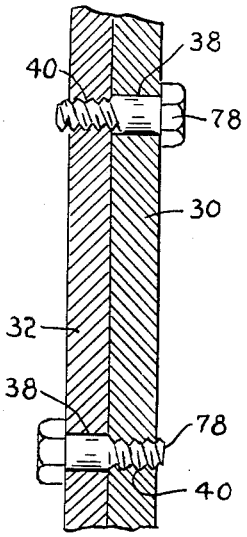
Fig.-8
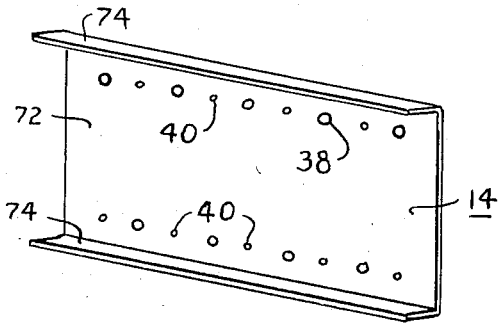
Fig.-9
Fig.-10
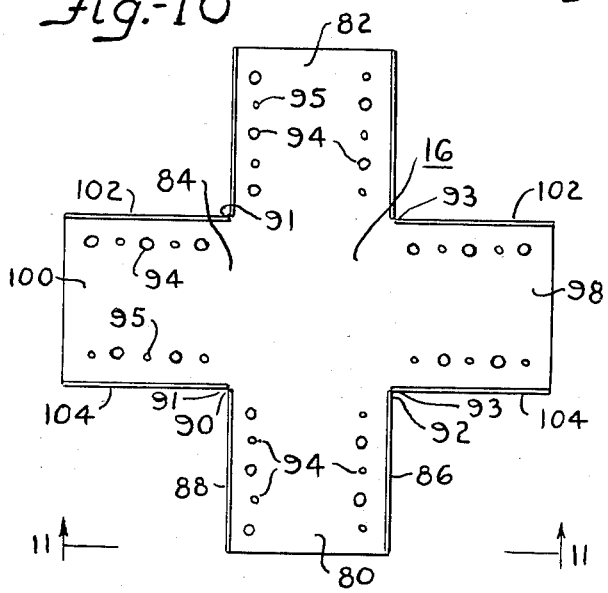
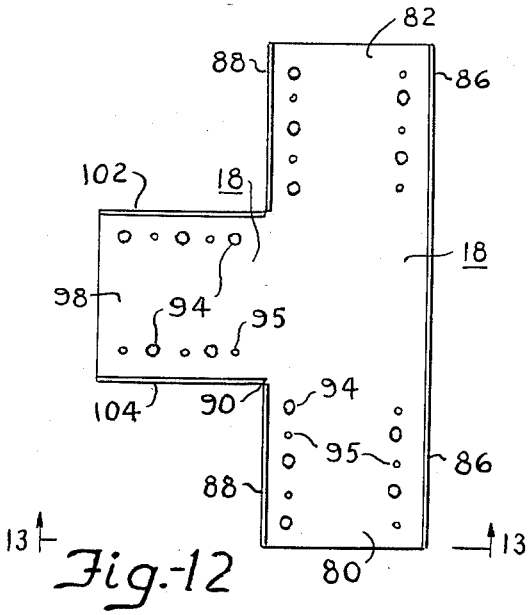
Fig.-12
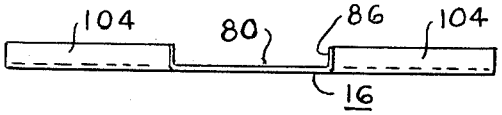
Fig.-11
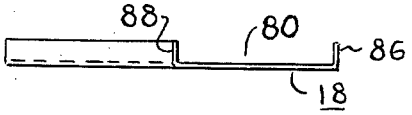
Fig.-13

BUILDING CONSTRUCTION

BACKGROUND OF THE INVENTION

The cost of building houses and other building constructions built on site by conventional building methods has increases substantially during recent years. This has been due to the increasing costs of materials and labor, and the fact that due to the age of specialization of the tradespeople it became necessary to have more people participate in the building of any structure.

In an attempt to cope with these increasing costs of construction efforts were made to apply factory techniques to the building of houses and other building constructions. Due to the wide range of designs that were needed to meet the demands imposed by the public and by industry, and the fact that competition has been keen, the quality of factory built houses has decreased. This resulted in such houses deteriorating more rapidly in value than houses built on site by conventional methods, thereby adding substantially to the overall costs of such houses.

This invention has been developed in an effort to overcome these difficulties and to provide a system whereby a very strong and accurately dimensioned framework can be produced on a basis that precision factory control can be applied to provide suitable frameworks for a wide range of building constructions to which any desired closure members can be applied.

The scope of this invention is very broad, and accommodates small relatively light constructions such for example as toys to large heavy constructions such as bridges or tall buildings. The thickness or gauge of the materials used can be increased as needed to accommodate the larger and more extensive constructions.

SUMMARY OF THE INVENTION

Broadly stated this invention consists of a plurality of substantially flat connector plates each plate having angularly related receptacles to receive load bearing girder, stud or rafter members having a single channel shaped member to accommodate small or light constructions, and for large buildings or heavy constructions having a pair of channel shaped members having their webs secured together in back to back relation, and having their flanges extending laterally in opposite directions.

Cooperating stop members between the connector receptacles and the load bearing girder, stud or rafter members being provided to limit telescoping movement of the load carrying members into the receptacles to align cooperating apertures in the load carrying members and the correspondingly spaced apertures in the connector receptacles whereby the load carrying members can be accurately assembled and securely fastened together.

The framework thus provided can be secured to a concrete or frame foundation to provide a strong and durable construction.

An object of this invention is therefore to provide a rigid and strong framework which can readily be made using precision procedures, and which can accurately be assembled to provide a wide range of constructions.

BRIEF DESCRIPTION OF THE DRAWINGS

Referring now to the drawings wherein similar reference characters refer to similar parts throughout the several views:

FIG. 1 is an elevational view, partly in sections, illustrating the framework of my improved building construction.

FIG. 2 is a fragmentary elevational view of a load bearing girder or joist member having channel members wherein their web sections are secured together in a back to back relation and their flanges extend laterally in opposite directions.

FIG. 3 is a perspective view showing a load carrying stud member secured to a concrete foundation.

FIG. 4 is a horizontal sectional view illustrating a load carrying stud.

FIG. 5 is a perspective view illustrating a single channel as applied to a grider or joist, and which can also be used as a stud or rafter member.

FIG. 6 is a side elevational view of a grider or joist member wherein the web members are secured together in a back to back relation, and the flanges of the channel members extend in opposite directions, it being understood that these same constructions can be used as studs or rafter members.

FIG. 7 is a view taken substantially on the line 7—7 of FIG. 6, looking in the direction of the arrows.

FIG. 8 is a sectional view illustrating the interconnection of the web members of two channel members of the girder or joist illustrated in FIGS. 6 and 7.

FIG. 9 is a perspective view illustrating a connector to connect two load carrying girder, stud or rafter members together by applying a connector to join together two members of the type illustrated in FIGS. 6 and 7.

FIG. 10 is a plan view of a connector plate having angularly related vertical and horizontal receptacles to receive load bearing stud and girder members.

FIG. 11 is a sectional view taken substantially on the line 11—11 of FIG. 10 looking in the direction of the arrows.

FIG. 12 is a view similar to FIG. 10 showing a connector plate adapted to interconnect vertically spaced and stud members, and to accommodate a single horizontal girder member.

FIG. 13 is a sectional view on line 13—13 of FIG. 12.

DESCRIPTION OF THE PREFERRED EMBODIMENT

Figure 14:
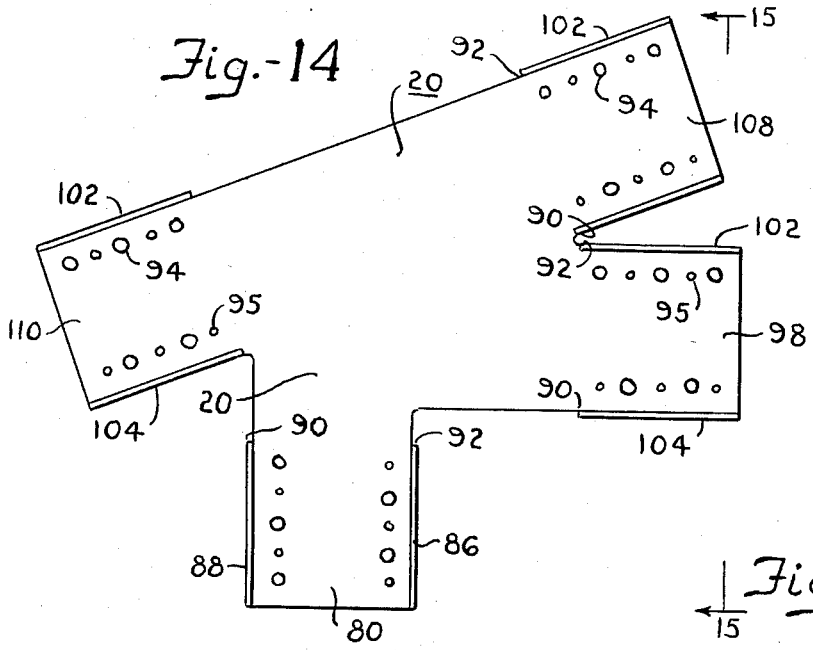
FIG. 14 is a plan view illustrating a connector plate having vertical, horizontal and angularly related receptacles to accommodate vertical and horizontal stud and girder members and roof rafters having a 4–12 pitch.

Referring now to the drawings the invention is illustrated in FIG. 1 as applied to a framework having a plurality of load carrying girder, stud and rafter members 10, 11 and 13 respectively mounted on a suitable foundation 12 formed of concrete. The girders 10, studs 11 or rafters 13 are connected together endwise by connectors 14 where relatively long girders or studs are required.

The girders 10, studs 11 and rafters 13 may be joined together as illustrated by the connector plates 16, 18, 20, 22 and 24 to provide a wide range of framework members. Suitable braces 26 and 28 may extend from the rafters 13 or from one of the connector plates as illustrated at 22 and extending to the girders 10 as desired to increase the strength of the overall construction.

As disclosed in FIGS. 3 and 4 of the stud members 11 a pair of reversely disposed channel members 30 and 32 having their webs 34 and 36 secured together as by spot welding or in any other convenient manner as by the use of oppositely directed screw threaded fasteners. The threaded fasteners are adapted to project into the alternately spaced large and small apertures 38 and 40 may be of the self tapping type to ensure a tight fit.

The webs 34 and 36 of the channels 30 and 32 may be formed with cut-out sections 42 which may be of any desired shape such for example as diamond shape, square, round, rectangular or oval or any other desired shape to reduce the weight of the material used and yet maintain a desired degree of strength in the overall structure.

The channel members 30 and 32 have their flanges 44 and 46 extending in opposite directions from their webs 34 and 36. The flanges 44 and 46 have inturned flange portions 48 and 50 to still further add to the strength of the members.

Referring now to FIG. 3 it will be noted that the studs 11 may be mounted on the foundation 12 with a modified channel shaped member 52 having a downturned flange 54 interposed between the studs 11 to engage and overlie the edge 56 of the foundation 12, and preferably terminating in an upturned flange 58 to add strength to the construction. The channel shaped member 52 has an upturned flange 50 spaced from the edge 56 of the foundation 12 to provide a space 60 in the pan of the channel shaped member 52 for the reception of the stud members 11. A stud anchor 62 has a channel shaped area 64 to overlie and surround the edge of the stud 11, and has an extended flange portion 66 adapted to overlie and surround the inturned flange portion 48 of the channel member 30. The lower end 68 of the stud anchor 62 is flat to lie along and engage the vertical side wall of the downturned flange portion 54 of the channel 52. Suitable fasteners 70 capable of being fired into the concrete extend through the lower edge 68 of the clamp 62 and the downturned portion 54 of the channel shaped member 52, and into the concrete of the foundation 12. Suitable fasteners 71 extend through the flange portion 66 of the stud anchor 62 and the inturned flange portion 48 of the channel 30. The studs 11 are thus securely anchored to the foundation 12.

FIG. 9 illustrates a type of girder or joist connector 14 to interconnect spaced girder members 10 in an end to end relation when it is desired to provide a girder or joist member 10 that is longer than can normally be transported to the site of construction on a vehicle or that is occasioned for any other reasons. As shown in FIG. 9 the channel shaped connector 14 has a web 72 and spaced flanges 74 adapted to slide into the girder 10 with the flanges 74 lying within the flanges 46 thereof and with the web 74 thereof lying along and engaging the flange 32 of the girder 10. Alternately spaced oppositely extending large and small holes 74 and 76 in the web 72 of the strut connector 14 are provided to receive screws 78 projecting through the web 72 of the connector 14 and the grider 10. The screws 78 are preferably self tapping screws to project into the small holes 76 and to cut their own threads therein thereby insuring a tight and solid connection.

As shown in FIG. 1 a wide range of connector plates 16, 18, 20, 22 and 24 are employed to illustrate various ways in which the load carrying girder members 10 can be connected to the stud members 11 and to the angularly inclined rafters 13 to provide a frame work structure capable of meeting virtually any desired constructional requirements. The girders 10, studs 11 and the rafters 13 are generally similar in construction.

Referring now to the connector plate 16 as more clearly illustrated in FIGS. 10 and 11 the load carrying studs 11 which are all alike, are projected into the lower and the upper receptacles 80 and 82 formed by the flat plate member 84 of the connector 16 and the side flanges 86 and 88 which provide a channel type structure into which the studs 11 are projected. The flanges 86 and 88 have inwardly directed stop members 90 and 92 which limit the telescoping movement of the studs 11 into the receptacles 80 and 82 of the connector plate 16 so that the large holes 94 in the flat plate 84 of the connector 16 line up precisely with the small holes 98 in the stud members 11.

Referring again to FIGS. 10 and 11 attention is directed to the fact that the connector plate 16 as shown in FIG. 1 is provided with horizontal slots 98 and 100 for the reception of horizontal girders or joists 10 to project into the receptacle between the flanges 102 and 104 which extend in opposite directions from the central section of the flat plate 84. Here again stop members 91 and 93 corresponding with the stop members 90 and 92 are provided to limit the telescoping movement of the girders 10 into the receptacles or horizontal slots 98 and 100 so that the large holes 94 in the plate 84 align accurately with the small holes in the girder members, and the large holes in the girders align accurately with the small holes 95 in the plate 84 so that the load supporting girders can be securely fastened to the connector plate 84. The horizontal slot 98 or receptacle in the connector plate 84 receives the horizontal girder 10 which form the second floor of the structure shown in FIG. 1.

The horizontal slot 100 or receptacle on the left hand side of the connector plate 16 receives a short girder or joist 10 positioned to lie beneath and within the confines of the overhang of the roof extension 106.

The opposite end of the long central girder 10 projects into the connector plate 18 as illustrated in FIG. 1, and in FIGS. 12 and 13. The arrangement with respect to the connector plate 18 with the lower and upper stud members 11 on the right hand side of FIG. 1 is the same as described in connection with the left hand side of FIG. 1. Corresponding parts have therefore been given corresponding reference numerals. Also the connection of the horizontal girder 10 which provides the framework for the second floor as shown in FIG. 1 and extending laterally from the connector plate 16 has also been given the corresponding reference numerals. It will be noted that since there is no extension of the building as shown in FIG. 1 to the right of the connector plate 18 there is no need to embody the horizontal girder 10 supporting mechanism on the right hand side of connector plate 18. It therefore extends straight up from the studs 11 as shown in FIG. 1.

Figure 15:
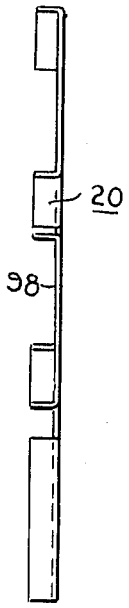
FIG. 15 is a view taken substantially on the line 15—15 of FIG. 14, looking in the direction of the arrows.
Figure 18:
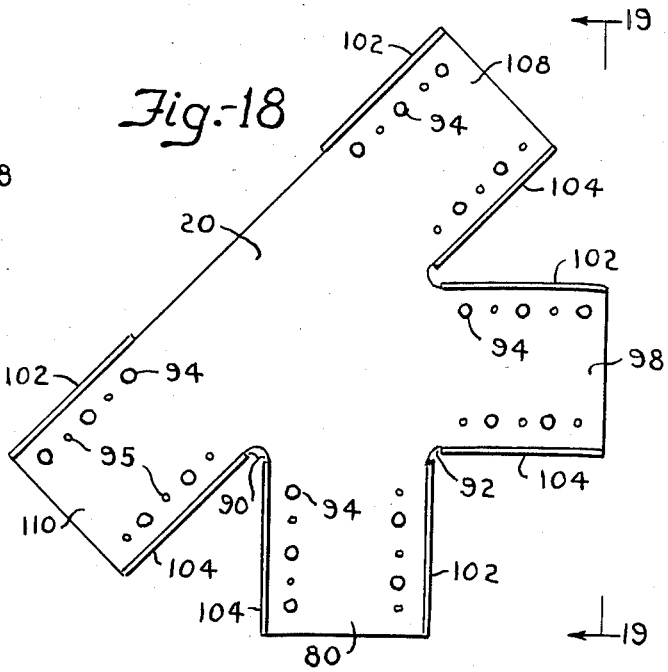
FIG. 18 is a view similar to FIG. 14 but showing the receptacle for the roof rafter disposed at a 12—12 pitch.
Figure 19:
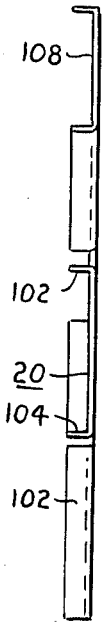
FIG. 19 is a view taken substantially on the line 19—19 of FIG. 18.

The roof supporting structures of FIG. 1 embodying the connector plates 20 shown in FIGS. 14 and 15 where the roof is positioned approximately at a 4–12 pitch or at a 20 degree angular pitch to the horizontal, and in FIGS. 18 and 19 where the roof is positioned at an approximately 12—12 pitch or at a 45 degree angle to the horizontal. These connector plates embody the same structures as do the connector plates 16 and 18 insofar as the stud and girder members of the vertical and horizontal members are concerned.

The connector plates 20 have been extended vertically and angularly to provide space for the angularly related roof sections 108 and 110 illustrated in FIGS. 14 and 18 to dispose the roof structures at the desired angular relation to the horizontal. The same reference numerals have therefore been used herein for the receptacles for accommodating the girder members 10 and for the stop members 90–92 for the vertical stud members and 91–93 for the horizontal girder members to insure proper alignment of the girder 10 and the stud 11 alignment with the receptacles in the connector plates 20 to insure that the large apertures 94 and the alternately spaced small apertures 95 are properly aligned in the connectors and the strut members.

Figure 20:
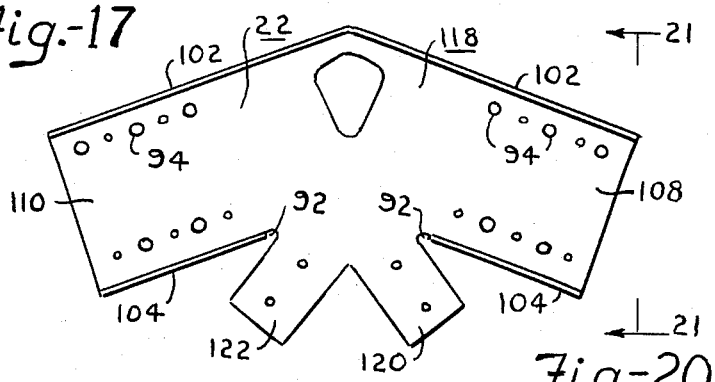
FIG. 20 is a plan view of a connector plate as applied to the ridge member of a roof structure adapted to be positioned at the top of the building structure and having angularly related receptacles to receive rafters to provide a 4–12 pitch roof.
Figure 21:
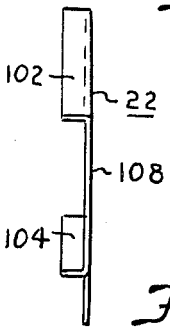
FIG. 21 is a view taken substantially on the line 21—21 of FIG. 20 looking in the direction of the arrows.

FIGS. 20 and 21 illustrate the roof ridge connector plate member 22 as shown in FIG. 1 wherein the angularly related sections 108 and 110 are disposed at the desired angular relation to the horizontal to produce the desired pitch of the roof. In this instance the roof ridge section 118 is set at an angle of approximately a 4–12 pitch corresponding with that of FIG. 14. The roof ridge 118 closes the top of the building shown in FIG. 1, and provides a structurally strong weatherproof construction. Angularly related members 120 and 122 are provided to receive the spaced bracing 26 as shown in FIGS. 1 and 20.

Figure 16:
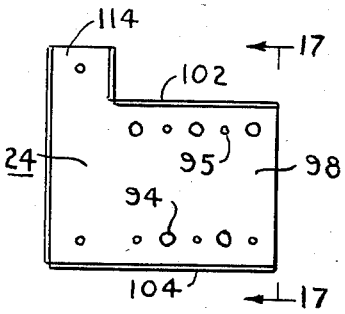
FIG. 16 is a view of a connector plate adapted to receive a horizontal girder and having an upstanding connector for a rail stud member.
Figure 17:
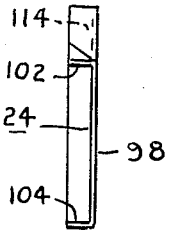
FIG. 17 is a view taken substantially on the line 17—17 of FIG. 16 looking in the direction of the arrows.

Referring to the connector 24 of FIG. 1 it will be noted that a short girder 10 terminating in the upstanding railing or guard rail 112 carried by the connector plate 114 as shown in FIG. 16 is provided to form a walkway under the roof extension 106 as illustrated in FIG. 1, and above the walkway 116 on the first floor and which is protected by the overhang roof extension 106.

Attention is directed to the fact that with my improved building contruction I am able to provide a very strong framework structure which meets the requirements structurally and architecturally for the erection of buildings of all types. With this construction the combination of the load supporting girders 10, studs 11 and rafters 13 having back to back channels having their flanges secured together in back to back relation with their flanges extending in opposite directions makes a very strong structure, particularly where the reversely directed flange members extend parallel with the channel webs. The thickness and type of the materials used in the formation of the load carrying girders, struts and rafters and the connector plates can be varied proportionately to the loading imposed to provide a structure capable of withstanding virtually any load to which the building structure is subjected. An economical and esthetically desirable structure results, and the framework thus produced can have any desired covering applied to it to adapt the resulting building for use in virtually any setting. It will be understood that my improved building structure is adaptable to cover a wide range of useages ranging from toys and light constructions where the single channel structure is capable of withstanding the loads to which the framework is subjected, and ranging up to constructions wherein very heavy loads are imposed, such for example as in bridge structures and in buildings where many floors are embodied and the number of channel supports or the thickness of their channel members is reduced the higher the building is to reduce the strength of the unit as the loading thereon is reduced.

While the connector plates 16, 18, 20, 22 and 24 have been described as having inwardly directed stop members 90 and 92, and 91 and 93 to limit telescoping movement of the girder or joist members 10, the stud members 11 or the rafter members 13, it will be apparent that the girders, studs and rafters can project over the extensions of the connector plates whereupon their telescoping movement will be stopped by contact with the laterally extending members.

I claim:

1. An improved system for constructing primary load-bearing frame structures for buildings and the like on a foundation, with prefabricated sets of interconnectable girder members, connecting plate members and attachment members for selectively securing the girder and plate members to one another, the improvement comprising:

the girder members being prefabricated in a plurality of incrementally different lengths and having flanges and webs forming channel-shaped cross-sections of uniform web width, at least some of the girder members being vertically-oriented;

each of the connecting plate members being prefabricated with flanges to form at least two angularly related receiving channels of uniform web width and cross-section and in a plurality of relative angles, the respective web widths of each girder and each receiving channel being dimensioned to enable portions of each to nest snugly one inside the other, primary loads being borne by and transmitted between the girder and plate members in planes defined by the nested webs, the flanges of the nested ends bearing against one another to provide high rotational rigidity and overall frame stiffness;

the set of attachment members being insertable through apertures in and engageable with nested portions of both the girder and plate members to provide full surface engagement of the nested web portions, whereby a plurality of frame structures for buildings, of varied size and shape, may be easily constructed from sets of prefabricated girder members and prefabricated connecting plate members secured together by a set of standard attachment members; and, means for securing the vertically-oriented girder members to the foundation.

2. A system according to claim 1, wherein the attachment members are bolts with self-tapping threads.

3. A system according to claim 2, wherein the apertures are formed in patterns of rows of holes.

4. A system according to claim 3, wherein the rows of holes are parallel to one another and centers of the holes of each row are in lateral alignment with centers of the holes of each other row.

5. A system according to claim 1, wherein the apertures are formed in identical patterns on both the ends of the girders and the receiving channels.

6. A system according to claim 2, wherein the receiving channels of the plate members are disposed at angles relative to one another enabling the girder members to be erected in horizontal, vertical and diagonal orientations.

7. A system according to claim 1, wherein the first members are provided with apertures throughout their length, enabling two of said girder members to be secured laterally to one another for enhancing load capacity.

8. A system according to claim 1, further comprising a plurality of base members for securing vertically oriented girder members to a foundation wall.

9. A system according to claim 8, wherein each of the base members comprises:

an L-shaped bracket for engaging adjacent horizontal and vertical surfaces of the foundation wall; and, first and second channel-shaped portions projecting upwardly from the bracket and opening toward one another, at least one of the channels having a flange with an inwardly directed angularly disposed lip for positively positioning one of the vertically oriented girders between the channel-shaped portions.

10. A building constructed with a primary load-bearing frame structure erected on a foundation from sets of prefabricated structural members, comprising:

a plurality of girder members, at least some of the girder members being vertically oriented each prefabricated in a plurality of incrementally different lengths having channel-shaped cross-sections of uniform web width;

a plurality of plate members, each prefabricated to form at least two angularly related receiving channels of uniform web width and cross-section and in a plurality of relative angles, the respective web widths of each girder and each receiving channel being dimensioned to enable portions of each to nest snugly one inside the other with respective perpendicular surface portions substantially flush with one another;

attachment means enagageable with nested portions of both the girder and plate members to provide full surface engagement of the nested web portions, whereby a plurality of frame structures for buildings, of varied size and shape, may be easily constructed from sets of prefabricated girder members and prefabricated plate members secured together by standard attachment means, whereby primary loads are borne by and transmitted between the girder and plate members in planes defined by the nested webs, the substantially flush perpendicular surface portions bearing against one another to provide high rotational rigidity and overall frame stiffness; and, means for securing the vertically-oriented girder members to the foundation.

11. A system according to claim 10, further comprising a plurality of base members for securing vertically oriented girder members to a foundation wall.

12. A system according to claim 11, wherein each of the base members comprises:

an L-shaped bracket for engaging adjacent horizontal and vertical surfaces of the foundation wall; and, first and second channel-shaped portions projecting upwardly from the bracket and opening toward one another, at least one of the channels having a flange with an inwardly directed angularly disposed lip for positively positioning one of the vertically oriented girder members between the channel-shaped portions.

13. An improved system for constructing primary load-bearing frame structures for buildings and the like from a prefabricated set of interconnectable members adapted for erection on a foundation as vertical beams, horizontal girders and diagonal braces, the improved system comprising:

the set of interconnectable members being prefabricated in a plurality of incrementally different lengths and having ends with lipped flanges forming channel-shaped cross-sections of uniform web width;

each of a set of a interconnection members being prefabricated with lipped flanges to form at least two angularly related receiving channels of uniform web width and cross-section in a plurality of relative angles, the respective web widths of each end of each interconnectable member and each receiving channel being dimensioned to enable portions of each to slidably engage in a direction along the longitudinal axis of the interconnectable members and nest snugly one inside the other, primary loads being borne by and transmitted between the interconnectable and interconnection members in planes defined by the nested webs, the lipped flanges of the nested ends bearing substantially flush against one another to provide high rotational rigidity and overall frame stiffness;

a set of attachment members for selectively securing the interconnectable members and the interconnection members to one another, the attachment members being insertable through apertures in and engageable with nested portions of both the interconnectable members and the interconnection members to provide full surface engagement of the nested web portions, whereby a plurality of frame structures for buildings, of varied size and shape, may be easily constructed from sets of prefabricated interconnectable members and prefabricated interconnection members secured together by a set of standard attachment members; and, means for securing the vertical beams to the foundation.

14. A system according to claim 13, wherein the attachment members are bolts with self-tapping threads.

15. A system according to claim 14, wherein the receiving channels of the interconnection members are disposed at angles relative to one another enabling the interconnection members to be erected perpendicularly, linearly and diagonally relative to one another.

16. A system according to claim 13, wherein the interconnectable members are provided with the apertures throughout their length, enabling any two of said interconnectable members to be laterally secured to one another for enhancing load capacity.

17. A system according to claim 13, further comprising a plurality of base members for securing vertically oriented interconnectable members to a foundation wall.

18. A system according to claim 17, wherein each of the base members comprises:

an L-shaped bracket for engaging adjacent horizontal and vertical surfaces of the foundation wall; and, first and second channel-shaped portions projecting upwardly from the bracket and opening toward one another, at least one of the channels having a flange with an inwardly directed angularly disposed lip for positively positioning a vertically oriented interconnection member between the channel-shaped portions.

* * * * *

UNITED STATES PATENT AND TRADEMARK OFFICE

CERTIFICATE OF CORRECTION

PATENT NO. : 4,551,957

DATED : November 12, 1985

INVENTOR(S) : Herbert L. Madray

It is certified that error appears in the above-identified patent and that said Letters Patent is hereby corrected as shown below:

Column 2, line 46 delete "and" (first occurrence).

Signed and Sealed this

*Eighth* Day of *July 1986*

[SEAL]

*Attest:*

DONALD J. QUIGG

*Attesting Officer*

*Commissioner of Patents and Trademarks*